United States Patent [19]

Knorr

[11] 4,047,355

[45] Sept. 13, 1977

[54] SHAFTWALL

[75] Inventor: William L. Knorr, Salem, Oreg.

[73] Assignee: Studco, Inc., Salem, Oreg.

[21] Appl. No.: 682,330

[22] Filed: May 3, 1976

[51] Int. Cl.[2] ..... E04C 3/07

[52] U.S. Cl. ..... 52/738; 52/303; 52/481; 52/495

[58] Field of Search ..... 52/720, 729, 732, 483, 52/481, 236, 241, 243, 479, 738, 198, 495, 281, 282, 303

[56] References Cited

U.S. PATENT DOCUMENTS

| | | | |
|---|---|---|---|
| 3,256,666 | 6/1966 | Farmer | 52/481 |
| 3,271,920 | 9/1966 | Downing, Jr. | 52/481 X |
| 3,276,179 | 10/1966 | Rallis | 52/481 |
| 3,394,507 | 7/1968 | Doke | 52/729 X |
| 3,483,665 | 12/1969 | Miller | 52/729 X |
| 3,517,474 | 6/1970 | Lanternier | 52/729 X |
| 3,533,205 | 10/1970 | Pestel et al. | 52/481 X |
| 3,562,970 | 2/1971 | Schwartz | 52/481 |
| 3,609,933 | 10/1971 | Jahn et al. | 52/481 X |
| 3,839,839 | 10/1974 | Tillisch et al. | 52/481 X |
| 3,921,346 | 11/1975 | Sauer et al. | 52/236 X |

FOREIGN PATENT DOCUMENTS

| | | | |
|---|---|---|---|
| 741,054 | 8/1966 | Canada | 52/729 |

*Primary Examiner*—Ernest R. Purser
*Assistant Examiner*—Robert C. Farber
*Attorney, Agent, or Firm*—Klarquist, Sparkman, Campbell, Leigh, Hall & Whinston

[57] ABSTRACT

I-beam studs of sheet metal have overlapped shaftwall portions having holes to provide for flow of cooling air along the overlapped portions to prevent failure of the studs from fire. First drywall sheets are mounted in the studs on the shaftwall sides thereof, and second drywall sheets are secured to the studs at the corridor sides thereof.

15 Claims, 9 Drawing Figures

SHAFTWALL

DESCRIPTION

This invention relates to an improved shaftwall, and has for an object thereof the provision of an improved shaftwall.

Another object of the invention is to provide a shaftwall having metal studs having ventilating apertures in overlapped portions thereof.

A further object of the invention is to provide an improved metal stud for a shaftwall, the stud being of sheet metal folded into an I-beam shape with an overlapping portion provided with ventilating holes spaced along one layer of the overlapping portion.

Figure 1:
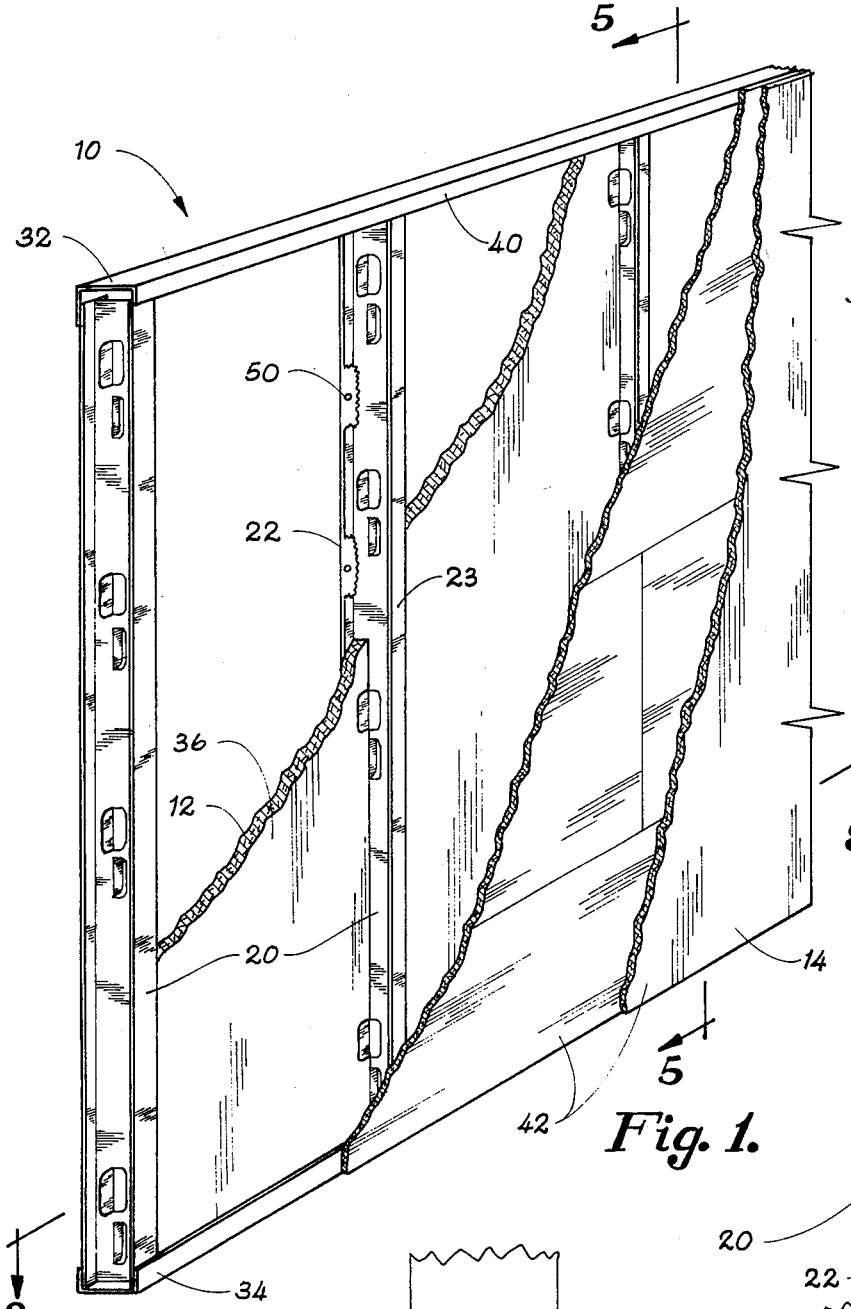
FIG. 1 is a fragmentary, perspective view of an improved shaftwall forming one embodiment of the invention.
Figure 2:
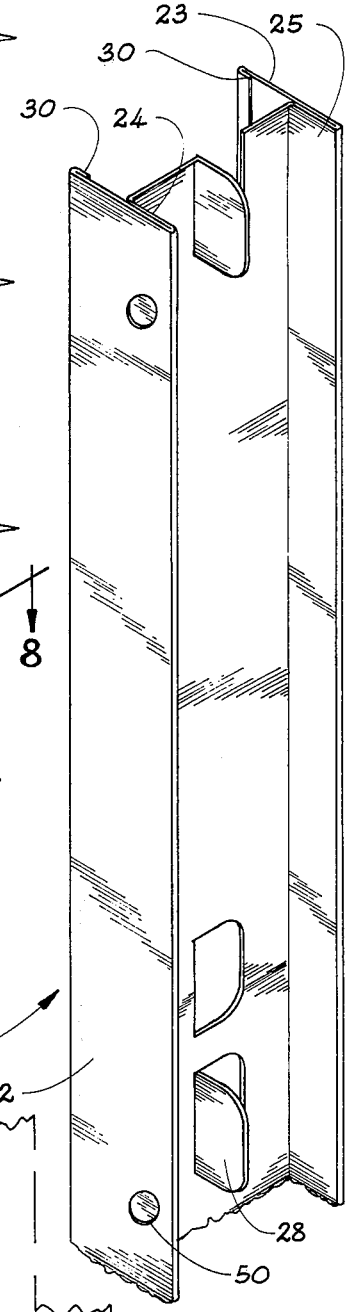
FIG. 2 is an enlarged fragmentary perspective view of a stud of the shaftwall of FIG. 1.
Figure 4:
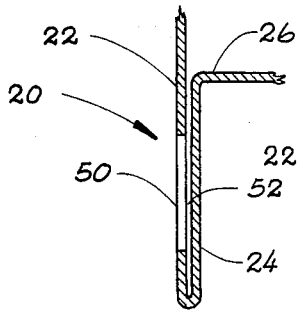
FIG. 4 is an enlarged, fragmentary, horizontal sectional view of the stud.
Figure 3:
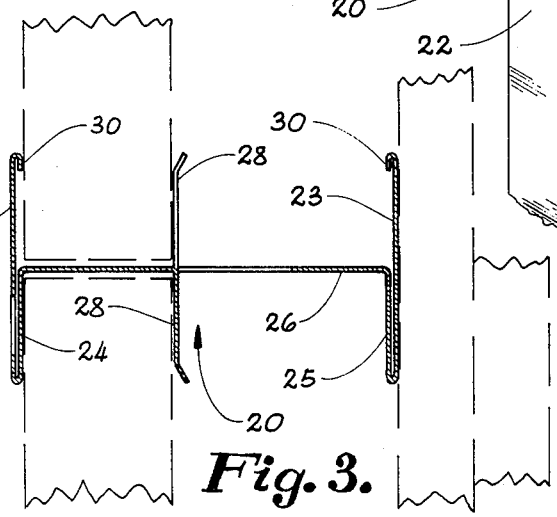
FIG. 3 is an enlarged, horizontal, sectional view of the stud.
Figure 5:
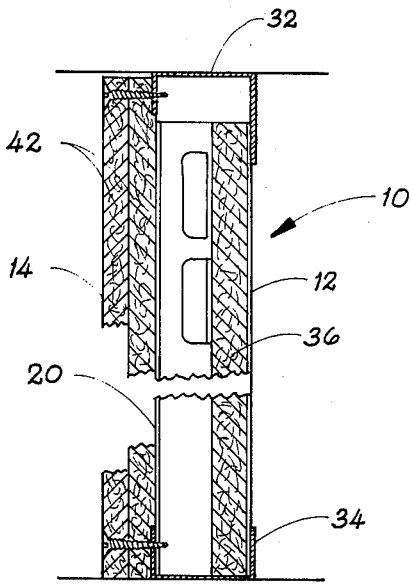
FIG. 5 is an enlarged, fragmentary, vertical sectional view taken along line 5—5 of FIG. 1.
Figure 9:
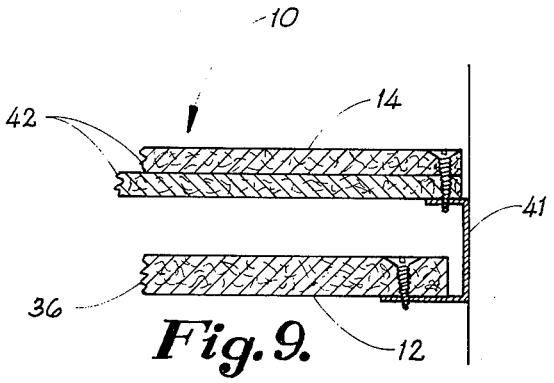
FIG. 9 is an enlarged, fragmentary, horizontal sectional view of an end wall connection of the shaft of FIG. 1.
Figure 7:
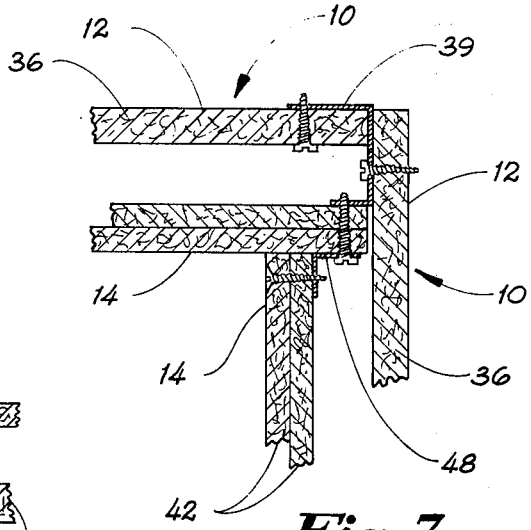
FIG. 7 is an enlarged, fragmentary, horizontal sectional view of an inside corner of the shaftwall of FIG. 1.
Figure 6:
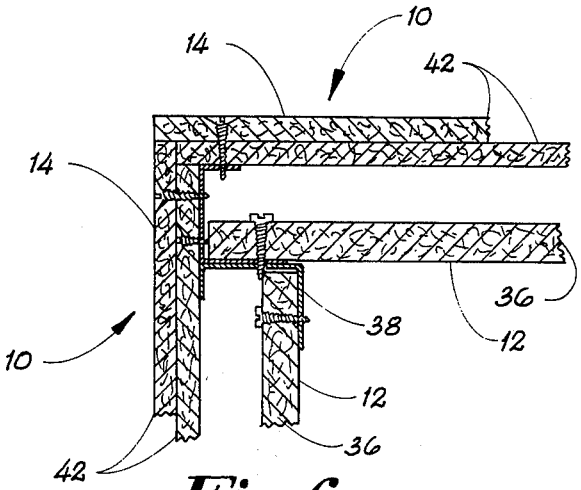
FIG. 6 is an enlarged, fragmentary, horizontal sectional view of an outside corner of the shaftwall of FIG. 1.
Figure 8:
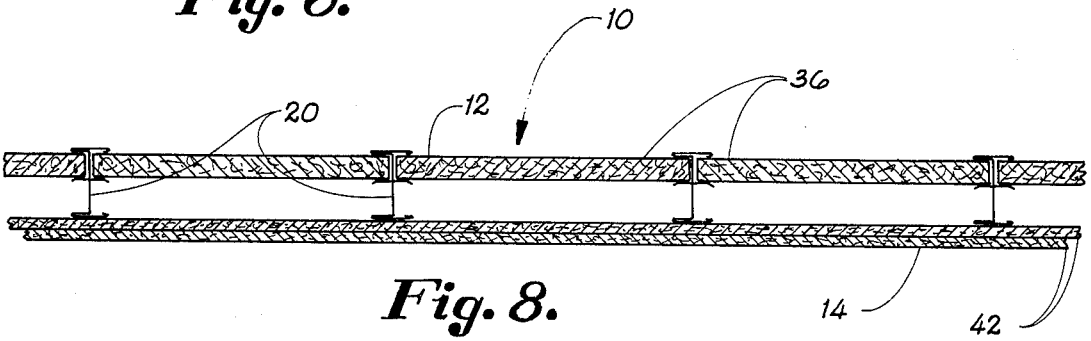
FIG. 8 is a fragmentary, horizontal, sectional view taken along line 8—8 of FIG. 1.

Referring now in detail to the drawings, there is shown therein an improved shaftwall forming a specific embodiment of the invention and including a side wall 10 having a shaft side 12 and a corridor side 14. The wall 10 includes novel I-beam studs 20 which are made by roll forming galvanized sheet metal. The studs include flanges 22 and 23 bent back on flanges 24 and 25 of a U-section 26. Spacer tabs 28 are provided for shaftwall (elevator and stairwall) construction and are ommited from housing wall construction. Bent over reinforcing edges 30 are provided on the free ends of the flanges 22 and 23.

In constructing the wall 10, top and bottom tracks 32 and 34 are fixed, an inner gypsum board 36 is slid into the tracks and into a corner member 38 or 39 or end member 41, the top track 32 having a narrower front flange 40 to permit the boards to be tilted into the lower track and then swung into the upper track. One of the studs 20 then is placed in the tracks and in position receiving the side edge portion of the board 36. The other boards 36 and studs are so positioned to form the inner wall. Then, outer gypsum boards 42 are secured by screws to the studs to complete the wall. In dry walls for houses, the tabs 28 are omitted and the boards are secured only to the flanges 22. Corner angle members 48 are provided for inside corners.

The portions of each of the flanges 22 overlapping one of the flanges 24 is provided with holes 50 therethrough to admit cooling air into a slight space forming a vertical passage 52 between the flange 22 and the flange 24. This gives a chimney effect to permit the air to travel through the holes and up the passages and out the tops of the studs to cool the studs and prevent excessive heat transfer. The holes, preferably, are of a diameter about one-half the width of the flanges 24 and are centered widthwise relative to the flanges 24. The holes, preferably, are spaced vertically about one foot apart along the studs starting near the bottoms of the studs. In one specific example, the holes were three-eighths of an inch in diameter, and the width of the flanges 24 was three-quarters of an inch.

What is claimed is:

1. In a shaftwall, a plurality of vertical studs of sheet metal, each stud having at one side thereof an inner flange and an outer flange folded back on and spaced from the first flange to form a thin, vertical passage open at the top and one side, the inner and outer flanges being parallel to each other and overlapping portions thereof forming a double thickness flange, the overlapping portions of the second flange having an opening therethrough into the space between the flanges, the openings being spaced low on the studs to admit air into the passages, and gypsum boards secured to the other side of the studs.

2. The shaftwall of claim 1 including second gypsum boards positioned adjacent the inner sides of the inner and outer flanges.

3. The shaftwall of claim 2 wherein each stud is an I-beam.

4. The shaftwall of claim 3 wherein each stud has a web and a plurality of tabs punched out of the web to hold the first-mentioned gypsum boards adjacent the flanges.

5. The shaftwall of claim 4 wherein there is a plurality of the openings in each stud spaced along the stud.

6. The shaftwall of claim 5 wherein the openings are substantially centered relative to the inner flanges.

7. The shaftwall of claim 6 wherein the inner flanges are of a predetermined width and the openings are holes of a diameter about one-half the width of the inner flanges.

8. The shaftwall of claim 2 wherein there is a plurality of openings in each stud spaced along the stud.

9. The shaftwall of claim 8 wherein the openings are substantially centered relative to the inner flanges.

10. The shaftwall of claim 9 wherein the flanges are of a predetermined width and the openings are holes of a diameter about one-half the width of the inner flanges.

11. A vertical sheet metal stud including:

a web, an inner flange joined to and extending laterally substantially at right angles to the web, and an outer flange joined to and folded back to parallel position over the inner flange to overlap the inner flange and spaced slightly from the inner flange to define an air passage therebetween, the overlapping portion of the outer flange having an opening therethrough to the air passage, the opening being spaced downwardly from the upper end of the air passage.

12. The stud of claim 11 wherein the opening is near the lower end of the stud.

13. The stud of claim 11 wherein there is a plurality of openings to the passage spaced along the stud.

14. The stud of claim 13 wherein the inner flange has a predetermined width and the openings are of a diameter about one-half of said predetermined width.

15. The stud of claim 13 wherein the openings are substantially centered relative to the inner flange.

* * * * *

UNITED STATES PATENT OFFICE

CERTIFICATE OF CORRECTION

Patent No. 4,047,355 Dated September 13, 1977

Inventor(s) William L. Knorr

It is certified that error appears in the above-identified patent and that said Letters Patent are hereby corrected as shown below:

Column 2, line 6 of claim 11 should read:

-- parallel position over the inner flange to overlap the --

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*

Notice of Adverse Decision in Interference

In Interference No. 99,853, involving Patent No. 4,047,355, W.L. Knorr, SHAFTWALL, final judgment adverse to the patentee was rendered Mar. 18, 1981, as to claims 1–5, 8, 11–14.

[*Official Gazette June 8, 1982.*]